US005743026A

United States Patent [19]

Cremona

[11] Patent Number: 5,743,026

[45] Date of Patent: Apr. 28, 1998

[54] DRYING DEVICE WITH IMPROVED GUIDE FOR ROTARY CUT WOOD VENEER

[75] Inventor: Lorenzo Cremona, Monza, Italy

[73] Assignees: Angelo Cremona; Figlio S.p.A., both of Milan, Italy

[21] Appl. No.: 750,427

[22] PCT Filed: Jun. 13, 1995

[86] PCT No.: PCT/EP95/02278

§ 371 Date: Dec. 11, 1996

§ 102(e) Date: Dec. 11, 1996

[87] PCT Pub. No.: WO95/35472

PCT Pub. Date: Dec. 28, 1995

[30] Foreign Application Priority Data

Jun. 17, 1994 [IT] Italy ..... MI940439 U

[51] Int. Cl.[6] ..... F26B 13/00

[52] U.S. Cl. ..... 34/639; 34/663

[58] Field of Search ..... 34/611, 614, 616, 34/623, 624, 629, 638, 639, 645, 646, 654, 660, 663; 242/172; 226/95, 171, 172

[56] References Cited

U.S. PATENT DOCUMENTS

| | | | |
|---|---|---|---|
| 1,658,684 | 2/1928 | Kocha | 34/568 |
| 1,777,764 | 10/1930 | Olson | 34/611 X |
| 1,833,880 | 11/1931 | Coe | 34/611 X |
| 2,792,700 | 5/1957 | Altosaar | 34/623 X |
| 3,334,421 | 8/1967 | Morris | 34/638 X |
| 4,399,619 | 8/1983 | Martin | 34/611 |
| 5,014,772 | 5/1991 | Ariga | 34/236 X |
| 5,062,218 | 11/1991 | Weil | 34/629 X |
| 5,261,146 | 11/1993 | Belliot | 34/623 X |

*Primary Examiner*—Henry A. Bennett
*Assistant Examiner*—Steve Gravini
*Attorney, Agent, or Firm*—Evenson, McKeown, Edwards & Lenahan, PLLC

[57] ABSTRACT

A device (10) for drying rotary cut wood veneer comprises at least two conveyor loops (11) facing each other along an outbound path to define between them a conveyance passage for the rotary cut veneer. Along the outbound path are present drying means (18) acting on the conveyance passage. The two conveyance loops comprise conveyance chains (13) supporting transversely to the direction of conveyance a sequential jointed plurality of rigid elements (12) providing facing and essentially unbroken conveyance surfaces along said outbound path to delimit the conveyance passage.

4 Claims, 1 Drawing Sheet

DRYING DEVICE WITH IMPROVED GUIDE FOR ROTARY CUT WOOD VENEER

BACKGROUND OF THE INVENTION

In the art of wood treatment, rotary cut wood veneer drying plants are well known.

U.S. Pat. No. 3,199,213 discloses a method for changing the moisture content of wood through strong heating and cooling. U.S. Pat. No. 3,623,235 shows a drying apparatus for veneers, having a conveyor for transporting the material through a passage between radiant drying units.

EP-A-0 451 346 discloses a dryer comprising hot plates hinged to each other for forming two caterpillars reciprocally faced to define a conveyance passage for the wood veneer. Devices of this kind have a structure very complex, since drying is carried out by heating fluid circulating along tubes inside the movable plates. The uniformity of drying is very low. Other known plants comprise a conveyance system moving the material to be dried under hot air currents.

GB-A-5335 discloses a device for drying slack objects like wet rags, conveyed on supporting plate conveyor through hot air flow. The supporting plates have some perforations for the passage of a certain amount of air. The conveying surface is interrupted by flanges bent at right angle on the conveying surface.

A further problem with known drying veneer plants when used for drying wood veneers is that during drying the veneer undergoes shrinking phenomena, which must be assisted to avoid cracking and damage to the wood, and deformation phenomena which on the contrary must be prevented as much as possible.

In the prior art there have been proposed plants in which the conveyance system is provided by a sequence of motorised rollers parallel with each other to be coupled on both sides of the rotary cut veneer. This permits the rotary cut veneer to run while assisting shrinkage. To allow passage of hot air it is however necessary to leave ample spaces between the roller pairs along the rotary cut veneer path. Between one pair and the next the rotary cut veneer can thus be deformed. The leading edge of the rotary cut veneer can also deviate from the established path and fit into the space between two pairs of rollers to jam the machine.

In some machines guide belts have been added and arranged to run between the rollers so as to guide the rotary cut veneer between one roller pair and the next. Because of its flexibility the guide belts cannot however prevent deformation of the rotary cut veneer along the path between the rollers.

There have also been proposed machines in which a chain system moves a plurality of equally spaced crosspieces arranged on either side of the rotary cut veneer to conduct it along the drying path. Even in this case deformation of the rotary cut veneer between two successive supports is not prevented.

The general purpose of the present invention is to overcome the above shortcomings by supplying a rotary cut wood veneer drying machine permitting perfect guidance of the rotary cut veneer and allowing free shrinking but preventing any deformation.

SUMMARY OF THE INVENTION

In view of said purpose it was sought to provide in accordance with the present invention a device for drying rotary cut wood veneer and comprising at least two conveyor loops facing each other along an outbound path to define between them a conveyance passage for the rotary cut veneer with there being along the outbound path drying means acting on the conveyance passage and characterized in that the two conveyance loops comprise conveyance chains supporting transversely to the direction of conveyance a sequential jointed plurality of rigid elements providing facing and essentially unbroken conveyance surfaces along said outbound path to delimit the conveyance passage.

BRIEF DESCRIPTION OF THE DRAWINGS

To clarify the explanation of the innovative principles of the present invention and its advantages compared with the prior art there is described below with the aid of the annexed drawings a possible embodiment thereof by way of non-limiting example applying said principles. In the FIG. 1 shows a schematic side view of drier in accordance with the present invention.

DETAILED DESCRIPTION OF THE INVENTION

Figure 1:
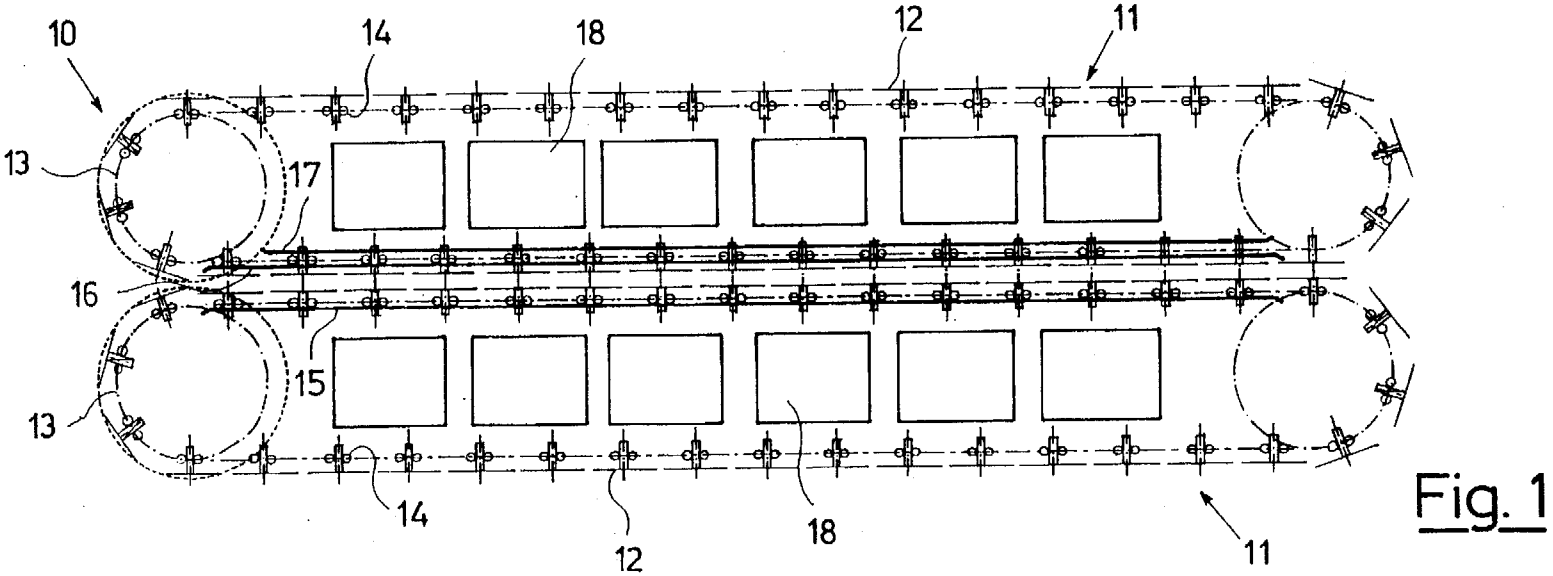

With reference to the figures, FIG. 1 shows schematically a drier indicated as a whole by reference number 10 and comprising at least two motorised conveyor loops 11 facing each other along an outbound section along which are present drying means provided by devices 18 for hot air emission and moisture removal essentially of the prior art and which act on a rotary cut veneer sheet conveyed by the conveyors 11 in the space between the two facing sections.

In accordance with the present invention, along the outbound path the conveyors 11 define a conveyance passage for the rotary cut veneer delimited by a sequential jointed plurality of rigid elements 12 which provide facing and essentially unbroken handling surfaces along the outbound path as may be seen in FIG. 1.

The elements 12 are supported along handling chains 13 coupled at the two lateral ends of the rigid elements 12. Advantageously each rigid element is supported at its opposite ends by a pair of carriages 14 with each carriage of the pair running at least along the outbound path along corresponding guides. Advantageously each carriage 14 forms a link of a handling chain.

To keep a predetermined distance between the superimposed surfaces defined by the mobile elements the lower conveyor carriages are at least rested on a rail 15 while the upper conveyor carriages are guided in support on a first lower rail 16 and have their vertical movement prevented by a second upper rail 17.

Figure 2:
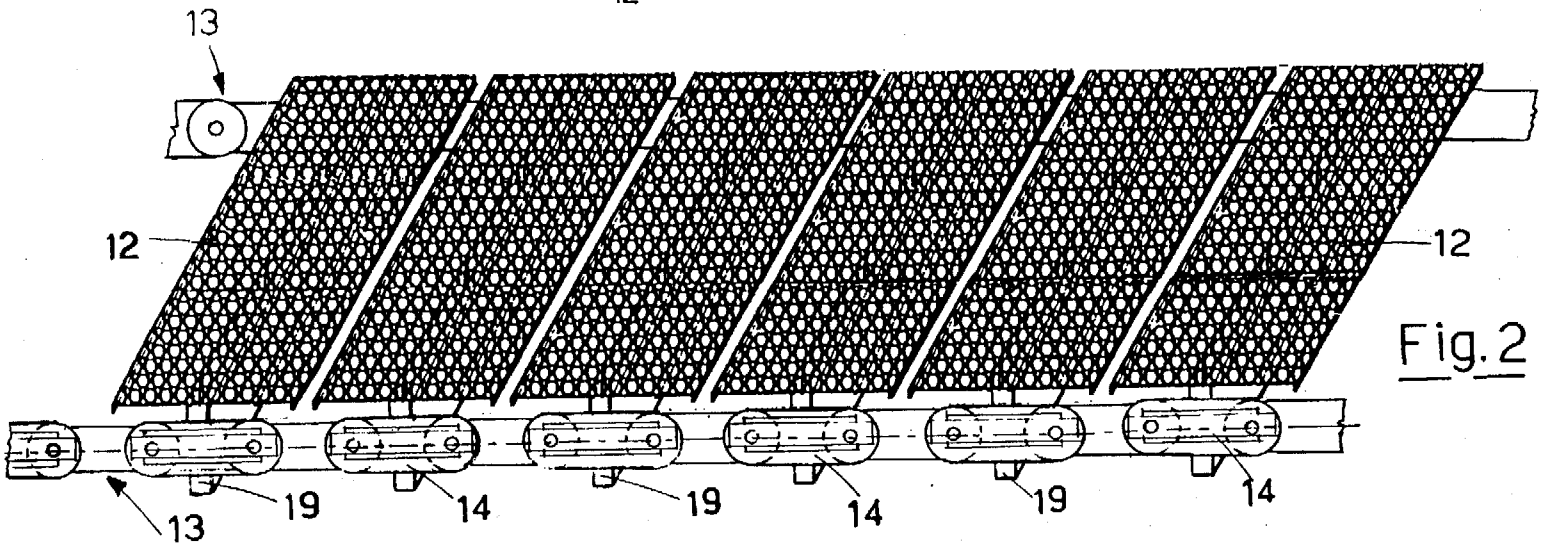
FIG. 2 shows a schematic perspective view of a part of the drier of FIG. 1.

As may be seen in FIG. 2 the rigid elements 12 are provided in generally rectangular form extending transversely to the direction of motion of the conveyor chains and are pierced to permit passage of air between the drying means 18 arranged on one side thereof and the conveyance passage on the other side.

To preserve an essential rigidity of each element 12 and prevent bending thereof even in the case of high extensions transverse to the path of movement, between each pair of carriages 14 is arranged a crosspiece 19 supporting the rigid element having generally the form of the letter T.

It is now clear that the preset purposes have been achieved. In the conveyance path of the rotary cut veneer the rotary cut veneer is guided between essentially rigid and unbroken surfaces made up of the rigid elements 12. Thus any deformation transverse to the direction of motion of the rotary cut veneer is prevented.

But at the same time a sliding of the rotary cut veneer caused by shrinking due to the drying operation is permitted.

By appropriately adjusting the distance between the carriage guides it is also possible to adjust the distance between the facing conveyance surfaces so as to have a predetermined pressure on the rotary cut veneer passing through the conveyance and drying passage.

Naturally the above description of an embodiment applying the innovative principles of the present invention is given merely by way of example and therefore is not to be taken as a iimitation of the patent right claimed here. For example, the drier can be made up of multiple elements 10 superimposed so as to provided a plurality of drying paths.

In addition the conveyor chain structure could be different from that shown schematically as is readily imaginable to those skilled in the art.

I claim:

1. Device (10) for drying rotary cut wood veneer comprising at least two conveyor loops (11) facing each other along an outbound path to define between them a conveyance passage for the rotary cut veneer with there being along the outbound path drying means (18) acting on the conveyance passage by means of hot air flow, characterized in that the two conveyance loops comprise handling chains (13) supporting transversely to the direction of conveyance a sequential jointed plurality of rigid guidance elements (12) providing facing and essentially unbroken conveyance surfaces along said outbound path to delimit the conveyance passage, preventing deformation of the rotary cut wood veneer transverse to the direction of motion, the rigid guidance elements (12) being pierced to permit passage of air between the drying means (18) arranged on one side thereof and the conveyance passage on the other side.

2. Device in accordance with claim 1 characterized in that at least along the outbound path each rigid guidance element (12), provided in a generally rectangular form, is supported at its opposing ends by a pair of carriages (14) running along guides (15, 16, 17) arranged along said path.

3. Device in accordance with claim 2 characterized in that each carriage (14) makes up a link of a conveyance chain.

4. Device in accordance with claim 2 characterized in that between each pair of carriages (14) is arranged a crosspiece (19) supporting the rigid guidance element (12) with a T conformation.

* * * * *